US008330610B2

(12) United States Patent
Freissle et al.

(10) Patent No.: US 8,330,610 B2
(45) Date of Patent: Dec. 11, 2012

(54) SYSTEM, METHOD, AND APPARATUS FOR DETECTING WEAR IN A SCREENING ARRANGEMENT

(75) Inventors: Peter Helmut Franz Freissle, Spartanburg, SC (US); Manfred Freissle, Johannesburg (SA); Mark V. Weaver, Columbus, NC (US); Patrick Fraser King, Simpsonville, SC (US); Gregory Anderson, Spartanburg, SC (US)

(73) Assignee: Polydeck Screen Corporation, Spartanburg, SC (US)

( * ) Notice: Subject to any disclaimer, the term of this patent is extended or adjusted under 35 U.S.C. 154(b) by 337 days.

(21) Appl. No.: 12/782,198

(22) Filed: May 18, 2010

(65) Prior Publication Data

US 2011/0285541 A1 Nov. 24, 2011

(51) Int. Cl.
*G08B 21/00* (2006.01)

(52) U.S. Cl. ..... 340/680; 340/650; 209/2; 209/370

(58) Field of Classification Search ..... 340/680, 340/664, 650; 209/2, 401, 370, 392; 324/71.1, 324/71.2

See application file for complete search history.

(56) References Cited

U.S. PATENT DOCUMENTS

| | | | | |
|---|---|---|---|---|
| 3,834,534 | A | 9/1974 | Peterson et al. | |
| 3,963,603 | A * | 6/1976 | Bunn et al. | 208/164 |
| 3,963,605 | A | 6/1976 | Seabourn | |
| 6,543,620 | B2 | 4/2003 | Allaei | |
| 6,698,593 | B1 * | 3/2004 | Folke et al. | 209/404 |
| 6,997,325 | B2 | 2/2006 | DeCenso | |
| 7,143,007 | B2 * | 11/2006 | Long et al. | 702/184 |
| 7,182,207 | B2 | 2/2007 | DeCenso | |
| 7,343,827 | B2 | 3/2008 | Biggs | |
| 7,461,972 | B2 | 12/2008 | Cohen | |
| 7,484,625 | B2 | 2/2009 | Scott et al. | |
| 7,492,254 | B2 | 2/2009 | Bandy et al. | |
| 2009/0301945 | A1 * | 12/2009 | Trench et al. | 209/405 |

FOREIGN PATENT DOCUMENTS

WO WO 2010/033526 3/2010

OTHER PUBLICATIONS

WO 2010033526 A1 (Twigger et al) Mar. 25, 2010.*
Search Report and Written Opinion for Application No. PCT/US2011/034740 dated Jul. 29, 2011.

* cited by examiner

*Primary Examiner* — Eric M Blount
(74) *Attorney, Agent, or Firm* — Dority & Manning, P.A.

(57) ABSTRACT

A system, method, and apparatus for detecting wear in a screening arrangement is disclosed. The system, method, and apparatus can include a sensor that is configured to provide a notification signal when a surface of a screen panel has worn to a threshold level. The threshold level can be based at least in part on the amount of wear that requires replacement of a screen panel to prevent breakthrough or contamination. The notification signal provided by the sensor can be used to identify which screen panel or region of screen panels has been worn to the threshold level so that the screen panels can be replaced in a timely manner. The sensor may be coupled to a conductor embedded in one of the screen panels that is altered when a screen panel has worn to a threshold level, triggering the sensor to provide the notification signal.

40 Claims, 10 Drawing Sheets

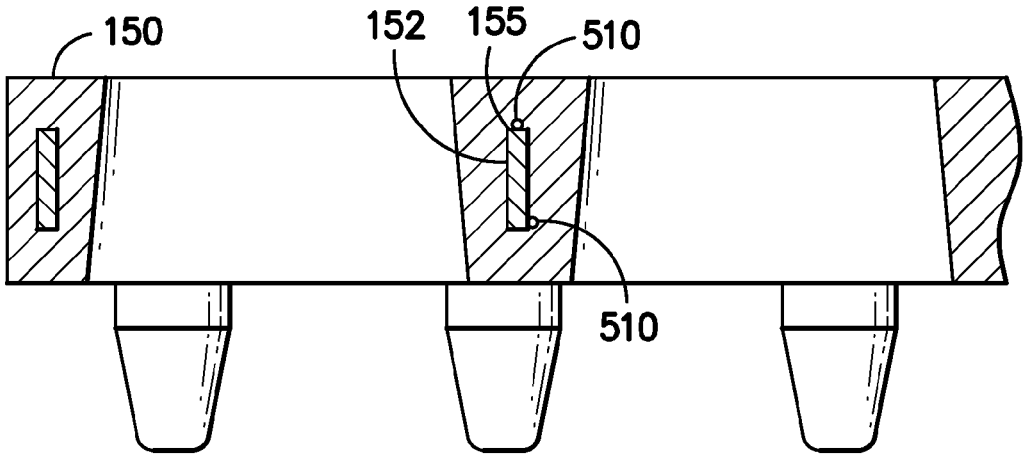
FIG. –10–
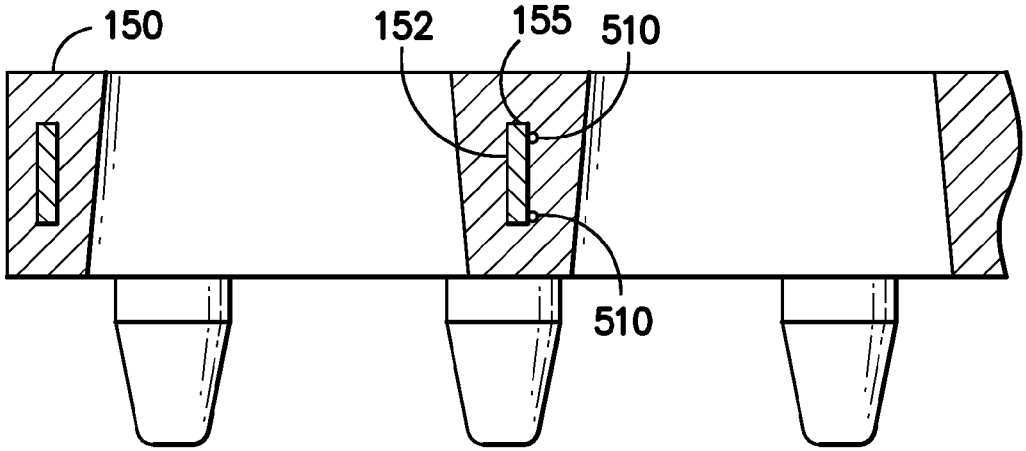
FIG. –11–

SYSTEM, METHOD, AND APPARATUS FOR DETECTING WEAR IN A SCREENING ARRANGEMENT

BACKGROUND

Screening arrangements are used in the mining and other industries to size and separate desired materials from less desired materials. Certain screening arrangements include modular screening systems which are composed of a plurality of modular and replaceable screening media mounted to a support frame. The screening media includes a plurality of apertures dimensioned to separate the desired material from less desired material.

Screening media can include modular screen panels which are removably mountable to a support frame. The individual screen panels can be constructed of an frame or insert that is encapsulated by a resilient material, such as a polymeric material, such as polyurethane or rubber. The individual screen panels can be mounted to the support frame and subjected to intense vibrations during the screening process. As materials are passed over the surface of the screen panels, desired materials pass through the apertures of the screen panels.

The intense vibrations from the screening process combined with the abrasiveness of the mined materials lead to wear in outer surfaces of the screen panels. Eventually, the wear in the outer surfaces of the screen panels can affect the size of the apertures in the screen panel and allow material of larger size to break through the screen panel so as to contaminate the material intended to pass through the screen panel. This breakthrough and contamination can result in mechanical problems in subsequent process steps, leading to repair costs and down time.

Preventive maintenance in the form of planned or scheduled replacement of screen panels based on past use and replacement statistics can result in premature replacement of screen panels, leading to additional waste and costs. Planned or scheduled replacement also ignores cases of unusual wear. Moreover, the problem of breakthrough can be so severe in certain circumstances that only reasonable guessing or detailed inspection of the screening arrangement when not in use can be applied, neither of which is cost effective.

Thus, a need exists for a system, method, and apparatus that identifies the exact time when a surface of a screen panel has worn to a threshold level where replacement of the screen panel is required.

SUMMARY

One exemplary embodiment of the present disclosure is directed to a system for detecting wear in a screening arrangement having a plurality of screen panels. The system includes a monitoring device and sensor. The sensor is positioned in the screening arrangement. The sensor is configured to provide a notification signal to the monitoring device when at least one of the plurality of screen panels has worn to a threshold level.

Another exemplary embodiment of the present disclosure is directed to a screening arrangement for use in screening materials. The screening arrangement includes a support member and a screen panel secured to the support member. The screen panel includes a peripheral edge portion and a plurality of ribs extending from the peripheral edge portion to define a screening surface. The plurality of ribs defines one or more apertures in the screen panel. The screening arrangement further includes a sensor mounted in the screening arrangement. The sensor can be configured to provide a notification signal when the screen panel has worn to a threshold level.

Another exemplary embodiment of the present disclosure is directed to a screen panel having a peripheral edge portion and a plurality of ribs extending from the peripheral edge portion to define a screening surface. The plurality of ribs defines one or more apertures in the screen panel. The screen panel further includes a sensor mounted in the screen panel. The sensor is configured to provide a signal indicative of a parameter of the screen panel. For instance, the sensor can be configured to provide a notification signal indicating the screen panel has worn to a threshold level.

A further exemplary embodiment of the present disclosure is directed to a screen panel for use in a system for detecting wear in a screening arrangement. The screen panel includes a peripheral edge portion and a top surface formed at least partially from a resilient material. A conductor is embedded in the resilient material and positioned in the resilient material so that the conductor is altered when the screening surface of the screen panel has worn to a threshold level. The conductor is configured to be coupled to a sensor that provides a notification signal when the conductor is altered in the screen panel.

Yet a further exemplary embodiment of the present disclosure is directed to a method for detecting wear in a screen panel. The method includes associating a sensor with a screen panel; monitoring signals from the sensor associated with the screen panel; and receiving a notification signal from the sensor associated with the screen panel when the screening surface of the screen panel has worn to a threshold level.

Variations and modifications can be made to these exemplary embodiments of the present disclosure.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 10 provides a cross-sectional view of the exemplary screen panel of FIG. 5 taken along line 10-10;

FIG. 11 provides a cross-sectional view of a variation of the exemplary screen panel of FIG. 5 taken along line 10-10;

DETAILED DESCRIPTION

Figure 1:
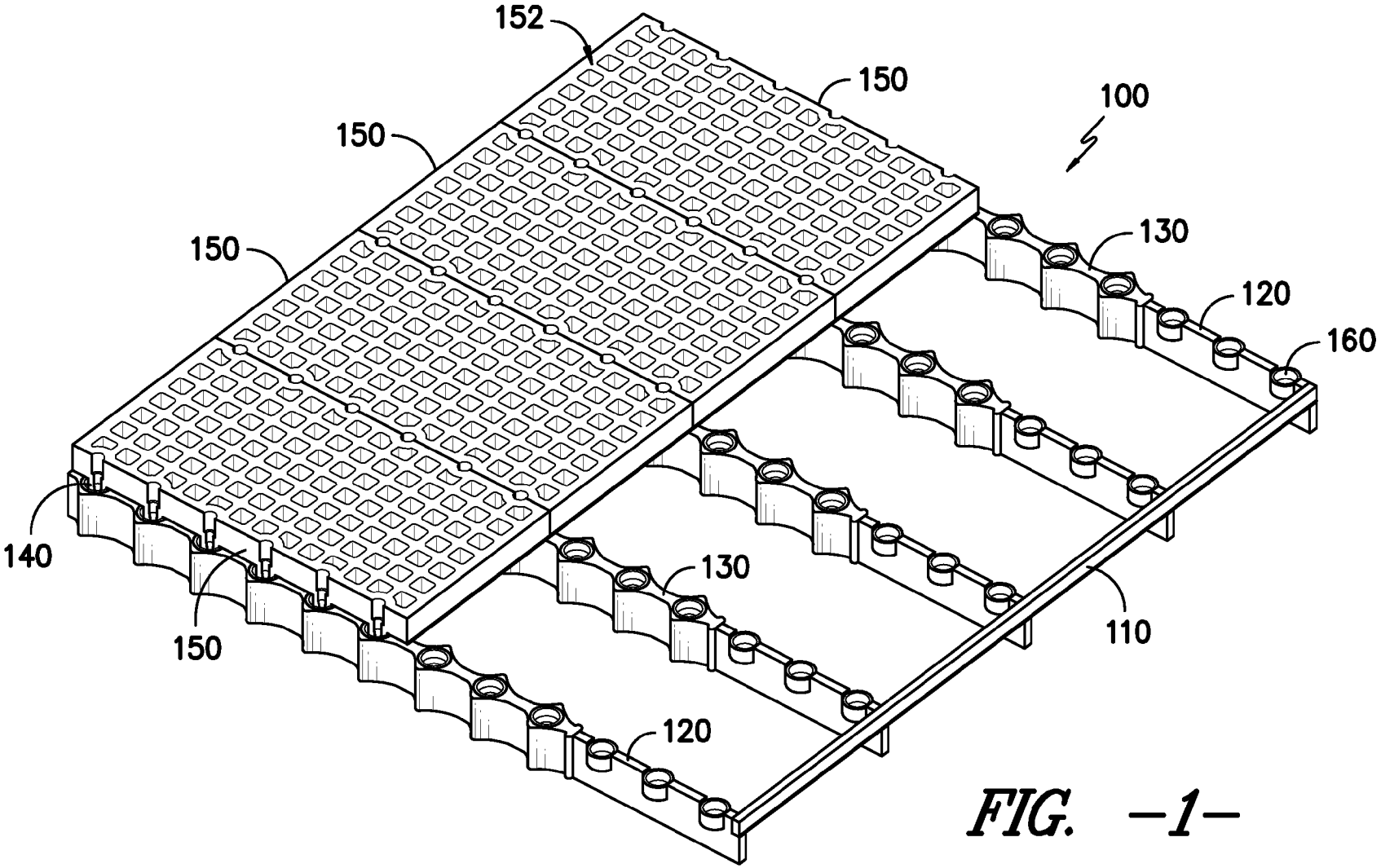
FIG. 1 provides a perspective view of a typical screening arrangement.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present disclosure is directed to the use of sensors in a screening arrangement and/or a screen panel used in the screening arrangement. The sensors can be used to detect wear and to provide a notification signal to a monitoring device when a surface of a screen panel has worn to a threshold level. The threshold level can be based at least in part on the amount of wear that requires replacement of a screen panel to prevent breakthrough or contamination. The notification signal can be used to identify which screen panel or region of screen panels have been worn to the threshold level so that the screen panels can be replaced in a timely manner. The ability to signal wear or need for replacement of a screen panel allows for enhanced run time for the screening arrangement with reduced risk of breakthrough or contamination. The sensor can also be used to provide other signals or information for monitoring vibration, temperature, location, conductivity, capacitive compression, clock signals, or other suitable parameters.

An exemplary screening arrangement 100 is depicted in FIG. 1. As illustrated, screening arrangement 100 includes a support frame 110 that includes a plurality of support members 120 mounted in parallel relationship to one another. Support frame 110 supports screen panels 150 which are used to separate and size material. Support frame 110 may be composed of steel or other material capable of supporting screen panels 150.

Figure 2:
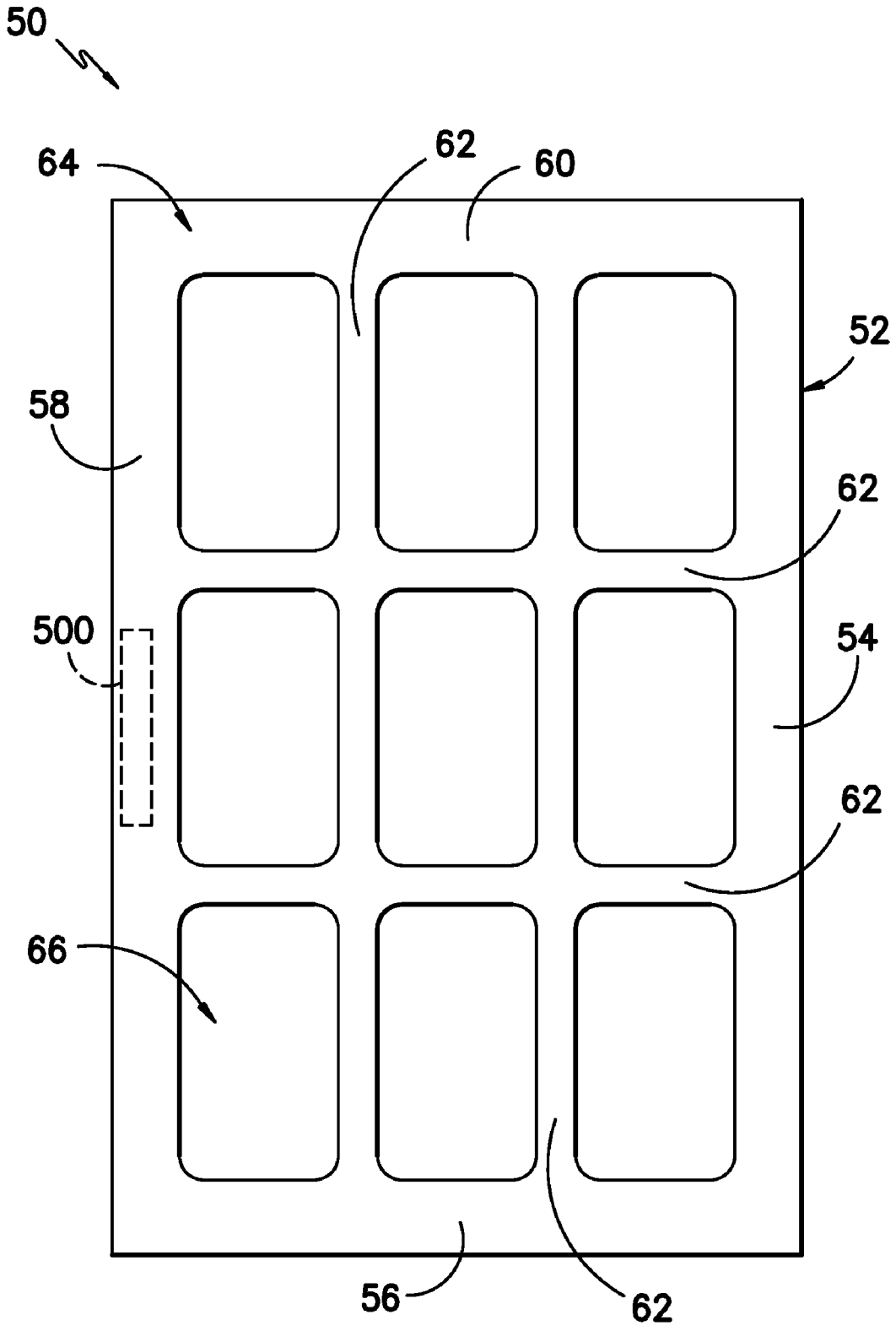
FIG. 2 provides a plan view of an exemplary screen panel according to an exemplary embodiment of the present disclosure.

FIG. 2 depicts a plan view of an exemplary screen panel 50 that can be used as part of screening arrangement 100. As illustrated, screen panel 50 generally includes a square or rectangular panel that includes a peripheral edge portion 52 having an upper surface, a lower surface, and an outer peripheral surface interconnecting the upper and lower surfaces. The peripheral edge portion 52 has a pair of mutually laterally spaced side members 54 and 58 and a pair of mutually axially spaced end members 56 and 60. A plurality of spaced ribs 62 extend across the panel 50 to define a screening surface 64. The ribs 62 define a plurality of apertures 66 in the screening surface 64. As will be discussed in more detail below, the screen panel 50 can include a sensor 500 that can be used in accordance with exemplary embodiments of the present disclosure.

Screen panels 150 illustrated in FIG. 1 are screen panels with square apertures 152, while screen panel 50 illustrated in FIG. 2 is a screen panel with rectangular apertures 66. Screen panels are available in a variety of different types of materials and can include apertures having a variety of different types and sizes. For example, certain screen panels can be formed from a resilient material such as polyurethane. Other screen panels can include steel. Screen panels can have square apertures, zig-zag apertures, ribbed apertures, elongated apertures, no apertures, or other apertures of varying width and length. The type of screening media or screen panels used in a particular screening arrangement can vary depending on the type of materials being screened and various other factors. Those of ordinary skill in the art, using the disclosures provided herein, will understand that a variety of different screening media and screen panels can be used without deviating from the scope of the present invention.

Referring to FIG. 1, a securing element 140 is used to secure screen panels 150 to support frame 110. Securing element 140 can include a sleeve adapted to receive a protrusion formed in the screen panels 150. An example of such a securing device is disclosed in U.S. Pat. No. 5,464,101, which is incorporated herein by reference for all purposes. However, the present disclosure is not limited to this exemplary securing device. For example, in another embodiment, securing element 140 can also include a protrusion adapted to engage an indentation formed in the screen panels 150. An example of such a securing element is disclosed in U.S. Pat. No. 6,957,741, which is incorporated herein by reference for all purposes. A variety of securing elements for securing screening media to a support frame are known. Using the teachings disclosed herein, those of ordinary skill in the art will recognize that any type of securing element can be used without deviating from the scope and spirit of the present invention. For example, the securing element can include rails, pins, snaps, or other securing elements.

Support members 120 can include a plurality of openings or sockets 160 for receiving the securing elements 140. The sockets 160 may be spaced at regular intervals or at irregular intervals along the length of the support members 120. A securing element 140 can be secured within a socket 160 in a variety of ways. For example, a securing element 140 can be secured to support member 120 by a screw thread. In other embodiments, securing element 140 can be snapped into support member 120.

Screening arrangement 100 can further include a plurality of protective covers 130 mounted in side-by-side relationship along the length of support members 120. Protective covers 130 can be used to protect support members 120 from abrasion during the screening process. The protective covers 130 can be formed from a variety of resilient materials that are resistant to abrasion, such as a high wear resistant polymer, such as polyurethane.

During a typical screening process, abrasive materials are passed along the screening surface of screen panels 150. Apertures 152 in screen panels 150 allow desired material to pass through screen panels 150 as the materials are passed along the screening surface of screen panels 150. The abrasive properties of these materials can lead to wear in the screening surface of screen panels 150. When the screening surface of a screen panel 150 has worn to a threshold level, the apertures 152 begin to allow particles to breakthrough the screen panel 150, leading to contamination of the screened material. When a screen panel 150 has achieved a threshold level of wear, the screen panel 150 can be disengaged from the support frame 110 and replaced with a new or different screen panel 150.

Certain exemplary embodiments of the present disclosure are directed to systems, apparatus, and methods that provide notification signals to signify when a screen panel 150 has achieved a threshold level of wear and should be replaced. When a monitoring device or user receives or becomes aware of the notification signal, the user can replace the worn screen panel 150 to prevent contamination of the screened material.

Figure 3:
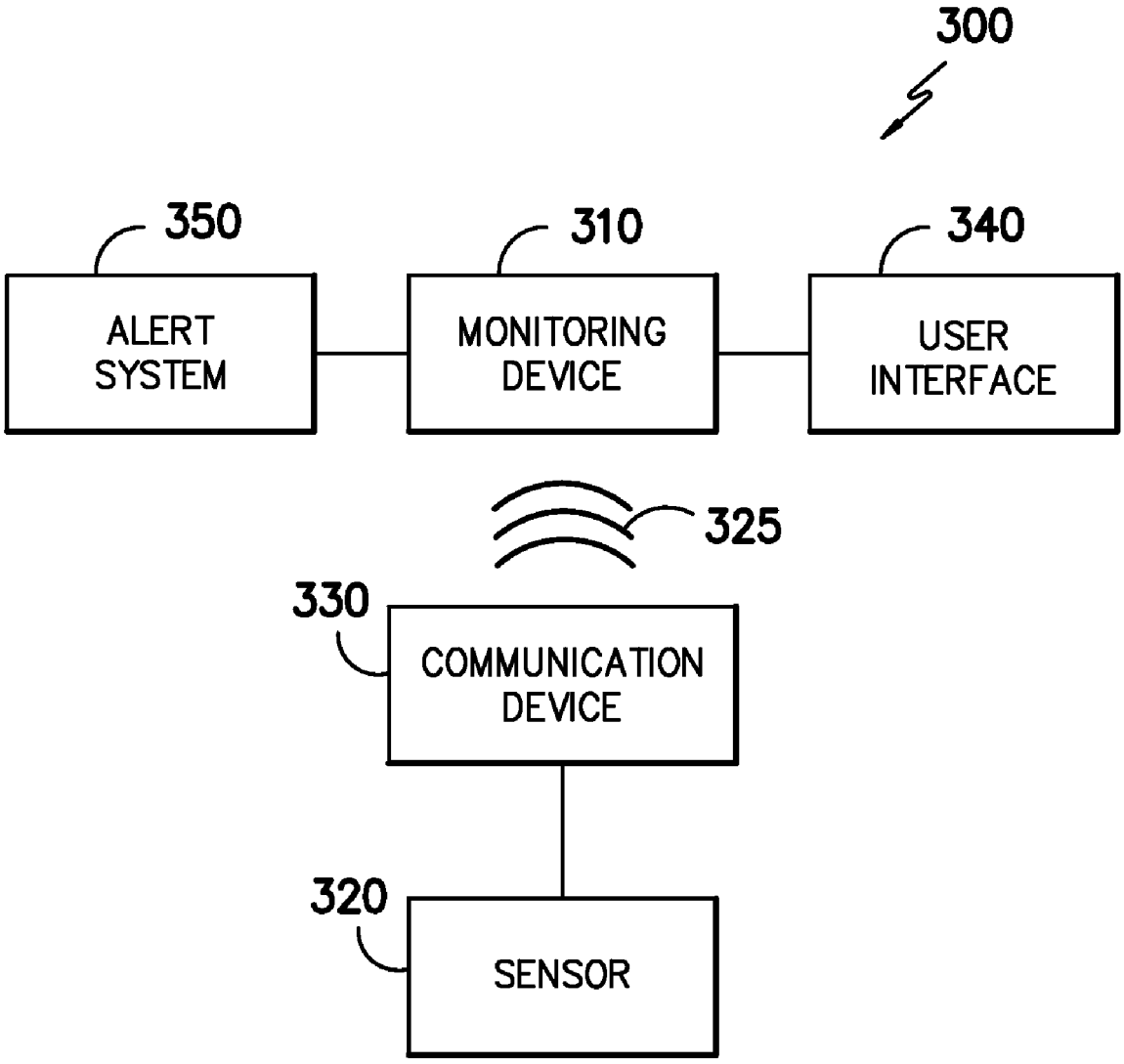
FIG. 3 provides a block diagram of an exemplary system for detecting wear in a screening arrangement according to an exemplary embodiment of the present disclosure.

FIG. 3 illustrates a block diagram of an exemplary system 300 for detecting wear in a screening arrangement having a plurality of screen panels. As illustrated, system 300 includes a monitoring device 310, a sensor 320, a communication device 330, a user interface 340, and an alert system 350. Sensor 320 can be any device configured to monitor or detect wear in a screening arrangement. Sensor 320 can vary in complexity and design, and can perform additional functions to detecting wear in a screening arrangement. For instance, in particular embodiments, sensor 320 can perform additional monitoring functions, such as monitoring vibration, temperature, location, conductivity, capacitive compression, clock signals, or other suitable parameters.

As illustrated, sensor 320 can be coupled to communication device 330. Communication device 330 can be used to transmit and receive signals 325 from monitoring device 310. While communication device 330 is illustrated as being separate from sensor 320, those of ordinary skill in the art, using the disclosures provided herein, should readily understand that sensor 320 and communication device 330 can be part of the same integral unit or apparatus. Communication device 330 can be any device for transmitting and receiving signals 325 from monitoring device 310. For instance, in a particular embodiment, communication device 330 can be configured to wirelessly communicate with monitoring device 310. In other embodiments, communication device 330 can be configured for hard wired communication to monitoring device 310. While individual links are shown in FIG. 3, it should be appreciated that communication between monitoring device 310 and sensor 320 through communication device 330 can occur over a network, such as a LAN, WAN, hard-wired, or wireless network, as well.

In a particular embodiment, communication device 330 can be based on radio frequency identification (RFID) technology. Examples of suitable communication devices can include active RFID devices, passive RFID devices, semi-passive RFID devices, Zigbee, Wi-Fi, Bluetooth and other suitable communication devices. In yet another exemplary embodiment, as will be discussed in further detail below, sensor 320 itself can be based on RFID technology. For instance, sensor 320 can be an RF Code R130 dry content RFID tag.

Monitoring device 310 can be any device configured to monitor incoming signals 325 from sensor 320. Monitoring device 310 can be a part of a portable device, such as a hand-held device, or stationary monitoring system. Monitoring device 310 can include a processor or controller programmed to receive, analyze and report information from incoming signals from sensor 320 to a user of system 300. The processor or controller can include computer readable instructions sufficient to perform a number of functions and methods related to the screening process and the incoming signals from sensors 320.

Monitoring device 310 can include or be coupled to a device for transmitting and receiving signals 325 from sensor 320. In a particular embodiment, monitoring device 310 can include a receiver and/or an interrogator. At least one signal 325 received from sensor 320 can include a notification signal. Notification signals can be used to indicate that a particular screen panel in a screening arrangement has worn to a threshold level. The threshold level sufficient to trigger a notification signal from sensor 320 can vary depending on the particular types of materials being screened and industry standards for the screening process. For instance, in one implementation, the threshold level can be relatively low such that any wear that has an effect on aperture size triggers a notification signal. In another implementation, the threshold level can be relatively high such that only catastrophic failure of a screen panel triggers a notification signal.

Monitoring device 310 can be coupled to a user interface 340 that allows a user or other operator of system 300 to manipulate and provide information to monitoring device 310. User interface 340 can include a graphical interface, visual display screen, or other suitable communication device that is used to provide results, analyses, reports, or other data to users of system 300. User interface 340 can include an input device, such as a keyboard, mouse, touch screen, key pad, voice command, or other suitable input device to allow a user to manipulate and control system 300 and input information into system 300. User interface 340 can be integral to monitoring device 310 or separate from monitoring device 310.

Monitoring device 310 can be further coupled to an alert system 350. Alert system 350 can be used to provide alerts or other indicia to users signifying that a particular screen panel has achieved a threshold level of wear. Alerts can include audible alarms, visual alarms, communications to relevant supervisors, communications to relevant maintenance technicians, communications to screen panel manufacturers, etc. Upon receipt of an alert, a user of system 300 can take active steps to remedy the notification of wear. For instance, the user can replace a worn screen panel(s) or with a new screen panel(s). In addition, the user can inspect the worn screen panel(s) to determine if replacement of the screen panel(s) is necessary.

Monitoring device 310 can be configured or programmed to perform a number of functions using signals received from sensor 320. For instance, monitoring device 310 can be coupled to a control system for a screening arrangement to control the screening arrangement to shut down the screening process when a notification signal is received from sensor 320. In another embodiment, monitoring device 310 can routinely report information received from sensor 320 to a database or remote location by wire or wireless communication. In another embodiment, monitoring device 310 can routinely report information received from sensor 320 to a screen panel manufacturer to provide constructive feedback regarding screen panel performance.

The notification signal can be a variety of different types of signals that provide an indication to monitoring device 310 that a screen panel has worn to a threshold level. For instance, in one embodiment, the notification signal can be a "report by exception" notification signal. In this particular embodiment, each particular screen panel or group of screen panels can be associated with a sensor 320 that routinely reports a message to monitoring device 310 until a point at which a screen panel has worn to a threshold level and requires replacement. In a particular embodiment, the routine signal provided by each sensor 320 can have a unique ID allowing specific correlation to a specific screen panel or group of screen panels in the screening arrangement. The unique ID can include a serial number of a predetermined number of characters that can distinguish a particular screen panel or group of screen panels from another particular screen panel or group of screen panels. When a screen panel achieves a threshold level of wear, the sensor 320 for that screen panel ceases to provide its routine signal to monitoring device 310, indicating to the monitoring device 310 that a particular screen panel or group of screen panels has reached a threshold level of wear.

For instance, a screening arrangement can include fifty screen panels. Each of the fifty screen panels can be associated with an individual sensor 320. Each sensor 320 can routinely report a routine message to monitoring device 310. When one of the fifty screen panels has worn to a threshold level, the sensor 310 associated with that particular screen panel no longer reports its routine message to the monitoring device 310. The failure of this particular sensor 320 to report its routine message to the monitoring device 310 indicates to the monitoring device 310 that the particular screen panel associated with the particular sensor 320 has been worn to a threshold level and potentially needs to be replaced.

The notification signal can also be an "active reporting signal." For instance, the sensors 320 can remain dormant and not provide any signal to monitoring device 310 until a screen panel has been worn to a threshold level. When the sensor 320 detects a threshold level of wear in a screen panel, the sensor 320 associated with the screen panel can provide an active notification signal to monitoring device 310. Those of ordinary skill in the art, using the disclosures provided herein, should understand that any of a variety of notification signals can be provided to monitoring device 310 indicating that a screen panel has been worn to a threshold level without deviating from the scope of the present invention.

In a particular embodiment, a notification signal is provided to monitoring device 310 when a conductor associated with sensor 320 and/or communication device 330 has been altered. The conductor can form a part of or be independent from sensor 320 or communication device 340. The conductor can be configured to transfer or transmit power, current, RF current, data, and/or other suitable signals within or to sensor 320 and/or communication device 330 or tied to an input/output (I/O) access point within the system. In other embodiments, conductor can be a component part of sensor 320 and/or communication device 330, such as an antenna, power source, or other component of sensor 320 or communication device 330. The conductor can be embedded in the resilient material and positioned in the resilient material so that the conductor is altered when the screening surface of the screen panel has worn to a threshold level. When the conductor becomes altered in the screen panel, a notification signal can be provided to monitoring device 310.

The conductor can be coupled to sensor 320 and/or communication device 330 through any of a variety of suitable connections. For instance, in a particular embodiment, a conductor can be directly coupled to sensor 320 and/or communication device 330 through a plug connection or hardwired connection. In other embodiments, the conductor can be indirectly coupled to sensor 320 and/or communication device 330, for instance, through a proximity sensor. The proximity sensor can detect the presence of the conductor through a capacitive, magnetic, optical, photoelectric, inductive, or other suitable connection.

Sensor 320 can be configured to provide other signals and/or information to monitoring device 310 in addition to notification signals. For instance, because a screening process typically requires intense vibration of the screening arrangement, sensor 320 can be used to provide historical vibration data that can provide valuable insight into the wear characteristics of the screening arrangement and its relationship to a particular screening arrangement or location within a screening arrangement. As another example, sensor 320 can further be used to provide temperature reporting to monitoring device 310. For instance, sensor 320 can be used to provide real time temperature of screen panels in the screening arrangement to determine if temperature characteristics are associated with unusual wear.

Sensor 320 can report its location in the screening arrangement through one of several techniques. For instance, triangulation scenarios common to real time locating systems can provide exact location. Programming GPS or sensor location into the monitoring device 310 at the time of mounting or maintenance is an additional technique. Sensor 320 can also determine its location relative to its peers if the sensor has "peer to peer" communication capabilities.

Sensor 320 can further include conductivity or resistivity sensing devices capable of reporting stress compression, wear, or other similar properties of a screen panel or the screening arrangement. For instance, sensor 320 could include a capacitive compression sensor capable of storing and/or reporting compression or wear information to monitoring device 310. Sensor 320 can also include a clocking function to provide timing information to the monitoring device. This allows sensor 320 to act as a data logger to provide a histogram of significant use or wear data during the course of the screening process. Sensor 320 could also include sensors indicating that a screen panel has not been placed in a correct location in the screening arrangement.

In particular embodiments of the present disclosure, sensor 320 is based on radio frequency identification (RFID) technology. For instance, sensor 320 can be coupled to a communication device 330 that is based on RFID technology, or the sensor 320 itself can be based on RFID technology. In particular, sensor 320 can include an RFID device that routinely reports information, such as a unique RFID signal, to monitoring device 310. When the RFID device ceases to provide a unique RFID signal to monitoring device 310, the RFID device effectively communicates a "report by exception" notification signal to the monitoring device 310, indicating to the monitoring device 310 that a screen panel has worn to a threshold level. While the remainder of the specification will be discussed with reference to a sensor that is based on RFID technology, those of ordinary skill in the art, using the disclosures provided herein, should understand that sensor 320 can be implemented using other types of devices, including sonic acoustic wave (SAW) devices, basic acoustic wave (BAW) devices, Electronic Article Surveillance (EAS), or other suitable devices.

Sensor 320 can include one or more active RFID devices, passive RFID devices, or semi-passive RFID devices. An active RFID device typically includes a power source, such as a battery, piezoelectric device, or other suitable power source, and an RFID communication unit that includes a radio transmitter or transceiver and other components of the RFID device. The RFID communication unit routinely provides an RFID signal, such as a unique RFID identifier, to a remote matched receiver. Active RFID devices typically transmit signals at a range of frequencies, from about 300 MHz to about 5.4 GHz, such as at about 313 MHz, 433 MHz, 900 MHz, 2.45 GHz, and 5.4 GHz. The receiver captures the RFID signal sent by the active RFID device and reports the signals to a monitoring device. If the power source is decoupled from the RFID base unit, the active RFID device may no longer be able to report its unique RFID signal to a monitoring device, providing a report by exception notification signal to the monitoring device.

A passive RFID device typically remains dormant and has no power source powering the RFID device. The passive RFID device turns on when it is in the presence of an interrogator. The passive RFID device typically includes an antenna that is optimized to absorb the key frequency of an associated interrogator when an RF signal from the interrogator is present. Low frequency passive RFID devices typically operate at about 100 to 300 KHz, such as at about 135 KHz. High frequency passive devices typically operate at about 12 MHz to about 15 MHz, such as at about 13.56 MHz. Ultra high frequency passive RFID devices typically operate at about 868 to about 958 MHz. Super high frequency passive RFID devices typically operate at about 2.45 GHz. The antenna collects the RF energy and transmits it to the base unit for the passive RFID device. The base unit converts the RF energy received from the interrogator into a low voltage to drive the functions of the base unit, including reporting the RFID signal of the passive RFID device back to the interrogator. If the antenna is decoupled from the base unit for the passive RFID base unit, the passive RFID device may no longer be able to report its unique RFID signal to a monitoring device, providing a report by exception notification signal to the monitoring device.

A semi-passive RFID device is similar to a passive RFID device except that a semi-passive RFID device uses a power source to assist the interrogator function by providing a low background power to the RFID base unit. The power source does not cause the semi-passive RFID device to transmit an RFID signal, but merely keeps the RFID device ready or awake so as to require only minimal RF power from an interrogator. This energy management feature of semi-passive RFID devices overcomes the need for the RF energy from an interrogator to serve all functions of which wake up typically has the greatest energy demand. In a semi-passive RFID device, if either the power source or the antenna is decoupled from the RFID base unit, the semi-passive RFID device may no longer be able to report its unique RFID signal to a monitoring system.

In operation, a sensor 320 can be an RFID device or associated with a particular RFID device configured to routinely report its unique RFID signal to monitoring device 310. When the screen panel achieves a certain threshold of wear, a conductor that forms a component part of the RFID device, such as conductor, antenna, power source, or other suitable conductor associated with the screen panel can become disabled. This action renders the RFID device no longer capable of reporting its unique RFID signal to monitoring device 310. The failure of the RFID device to report its unique RFID signal to monitoring device 310 indicates to monitoring device 310 that the particular screen panel associated with the particular RFID device has been worn to a threshold level.

Various techniques can be used to trigger the disabling of RFID devices concurrent with a surface of the screen panel being worn to a threshold level. For instance, one or more conductors coupling components of an RFID can be positioned in a screen panel such that the conductor become altered when a surface of the screen panel has worn to a threshold level. For example, the conductor can become severed, isolating components of an RFID device and causing the RFID device to cease transmitting its unique RFID signal.

A conductor can actively couple components of the RFID device above or can be designed as a sacrificial conductor coupled to a single component of the RFID device. The sacrificial conductor can be embedded in the screen panel such that once the screen panel begins to wear, the sacrificial conductor may become shorted or grounded to the metal frame of the screen panel. This ground or short disables the RFID device, causing the RFID device to cease transmitting its unique RFID signal.

In a particular embodiment, a component of the RFID device itself, such as an antenna of an RFID device, can be positioned in the screen panel such that the component of the RFID device becomes damaged when the screen panel has worn to a threshold level. The damage to the RFID component causes the RFID device to cease transceiving its unique RFID signal.

Figure 4:
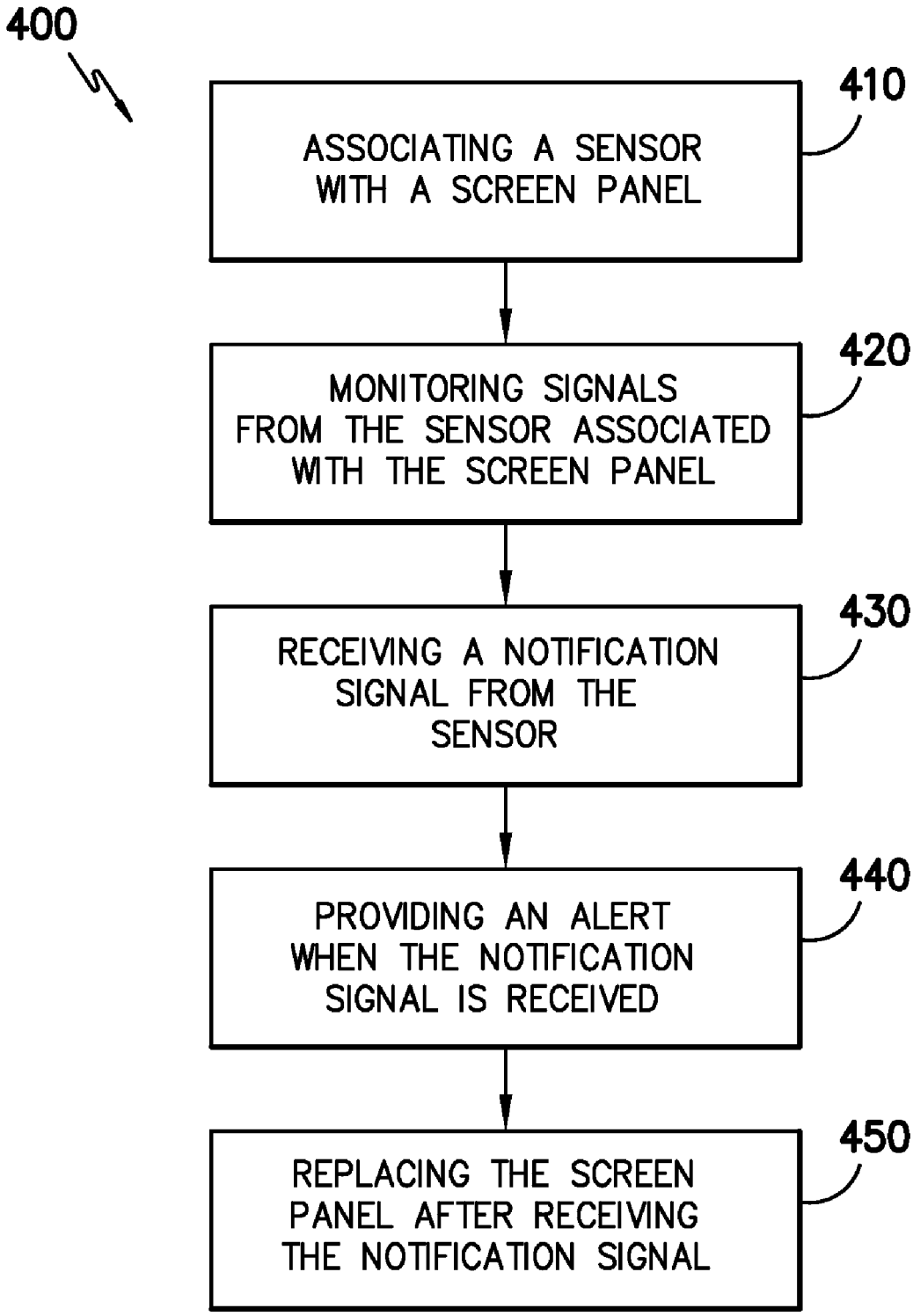
FIG. 4 provides a flow diagram of an exemplary method according to an exemplary embodiment of the present disclosure.

FIG. 4 depicts a flow diagram for an exemplary method 400 according to an exemplary embodiment of the present disclosure. At 410, the method 400 includes associating a sensor with a screen panel. A sensor can be associated with a screen panel by embedding the sensor in the screen panel or operatively coupling the screen panel to the sensor. In addition, a sensor can be associated with a screen panel by programming or configuring a monitoring device or other controller to associate a particular sensor with a particular screen panel. A single sensor can be associated with a single screen panel or a group of screen panels. The sensor can be configured to provide signals that are unique to a particular screen panel or group of screen panels. For instance, in particular embodiments, the sensor can be an RFID device or can be coupled to an RFID device that provides a unique RFID signal that is associated with a particular screen panel or group of screen panels.

At 420, the method 400 includes monitoring signals from the sensor associated with the screen panel. The signals can be monitored using a receiver and/or an interrogator that continuously or periodically monitors the sensor associated with the screen panel. The signals can include routine ID signals, active reporting signals, or signals representative of vibration, temperature, timing, location, defect, or other data.

At 430, the method 400 includes receiving a notification signal from the sensor. The notification signal can indicate that the screen panel associated with the sensor has been worn to a threshold level. As discussed in detail above, the notification signal can be a report by exception notification signal, an active notification signal, or other notification signal. For instance, in a particular embodiment, a notification signal is received when a sensor ceases to provide a unique identification signal.

At 440, the method includes providing an alert when the notification signal is received. The alert can be provided by an alarm system, and can include any type of visual, audible, or other alarm. In other embodiments, the alert can be a communication, such as an email, to an operator of the screening arrangement in which the screen panel is used or to a manufacturer of the screen panel. At 450, the method includes replacing the screen panel after receiving the notification signal.

Figure 5:
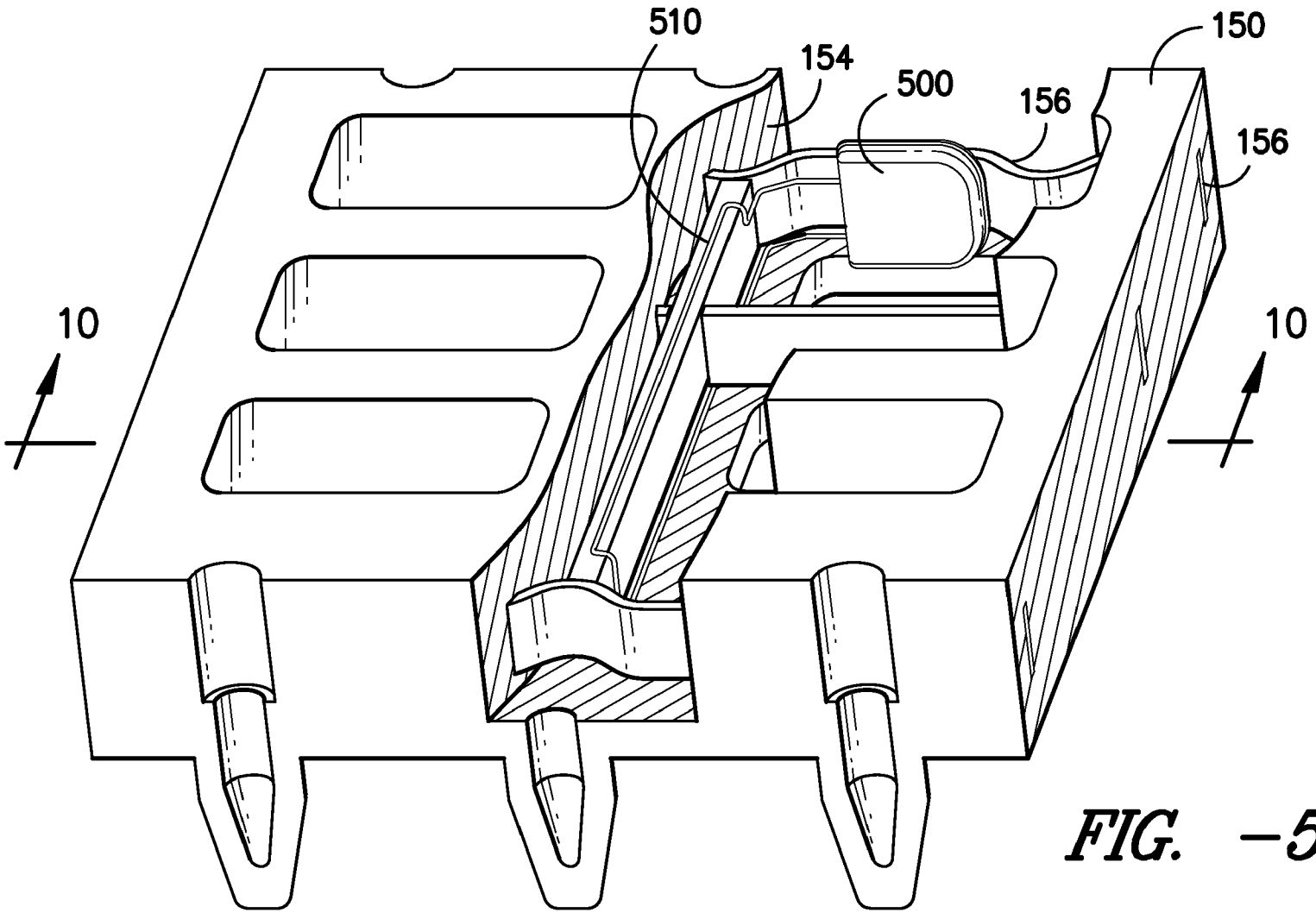
FIG. 5 provides a perspective view of an exemplary screen panel in accordance with an exemplary embodiment of the present disclosure with a portion of the screen panel cut away.

With reference now to FIGS. 5 through 10, various embodiments for implementing the system, apparatus, and method of the present disclosure will now be set forth. FIG. 5 provides a perspective view of an exemplary screen panel 150 that includes a frame or insert 156 and a resilient material 154 surrounding insert 156. Resilient material 154 can be a high wear resistant material, such as polyurethane, rubber, polyethylene, polypropylene, or other suitable material. Resilient material 154 defines a top surface or screening surface 155 for the screen panel 150. Resilient material 154 may include a plurality of ribs that define apertures in the screening surface of screen panel 150. In other embodiments, the screen panel 150 may not have any apertures.

Screen panel 150 includes a sensor 500 positioned within screen panel 150. Sensor 500 is preferably positioned in screen panel 150 so as to avoid being subjected to wear during the screening process. Sensor 500 can be any suitable device for sensing wear in the screen panel 150. For instance, sensor 500 can be an active RFID device, passive RFID device, or semi-passive RFID device that can operate at any desirable frequency.

Sensor 500 includes a conductor 510 positioned in screen panel 150. Conductor 510 can be used to couple various components of sensor 500. The conductor 510 can be configured to transfer or transmit power, current, RF current, data, and/or other suitable signals within the sensor 500 or tied an input/output (I/O) access point within the system. The conductor 510 could also be a component of sensor 500 such as an antenna or power source. Alternatively, conductor 510 can be a sacrificial conductor connected to one of the various components of sensor 500.

The various components of sensor 500 illustrated in FIG. 5 are illustrated as being part of a single integral package. However, those of ordinary skill in the art, using the disclosure provided herein, should understand that the various components of sensor 500 can be separated and located in different areas of screen panel 150 or the screening arrangement. Conductor 510 can be used to couple such separated components of sensor 500.

Figure 6:
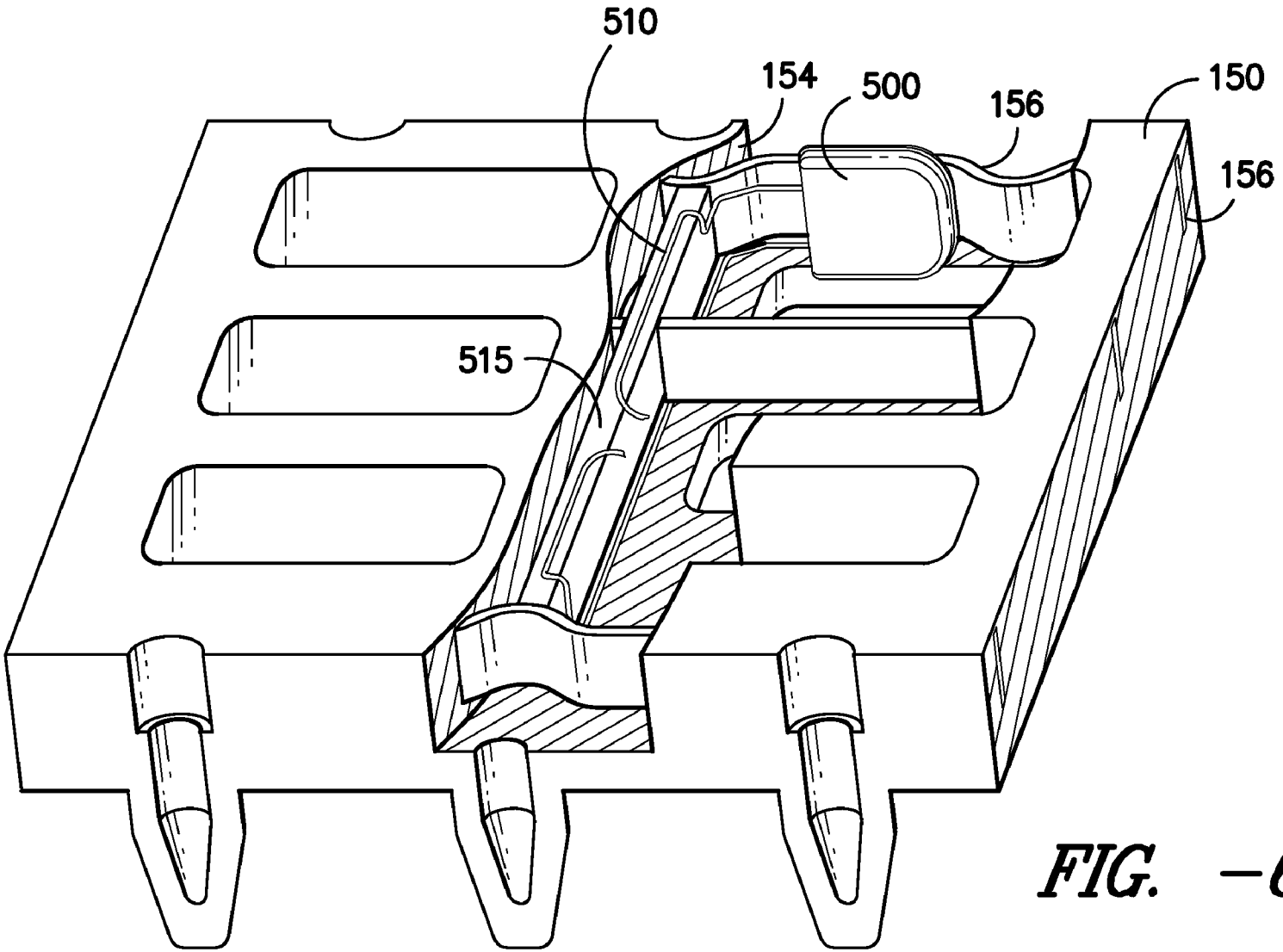
FIG. 6 provides a perspective view of an exemplary screen panel in accordance with an exemplary embodiment of the present disclosure with a portion of the screen panel cut away.

Conductor 510 is positioned in the screen panel so that the conductor 510 is altered when a surface of the screen panel has worn to a threshold level. For instance, FIG. 6 depicts screen panel 150 after it has been subjected to significant wear during a screening process. As illustrated, the resilient material 154 of screen panel 150 has been worn to such extent to cause the conductor 510 to become exposed and severed by the wear. The severing of the conductor 510 disables sensor 500 and prevents sensor 500 from transmitting a unique identification signal to a monitoring device. The failure of the sensor 500 to transmit its unique identification signal can act as a notification signal signifying that screen panel 150 has worn to a threshold level.

Conductor 510 can also be altered by becoming shorted or grounded to the insert 156 of screen panel 150. In this exemplary configuration, the conductor can be positioned in the screen panel such that as the resilient material 154 wears from use, the conductor 510 ultimately comes into electrical contact with the insert 156 of screen panel 150. This can short out various components of sensor 500, disabling sensor 500 from transmitting its unique identification signal. In still another embodiment, conductor 510 can be altered by becoming decoupled from sensor 500.

In a particular embodiment, sensor 500 includes an RF Code R130 dry content RFID tag. The RF Code R130 dry content RFID tag include two wires that when shorted together, causes the RF Code R130 dry content RFID tag to transmit a signal. The two wires of the RF Code R130 dry content RFID tag can be intentionally shorted together to form a conductor 510. When conductor 510 becomes altered due to wear in the screen panel, the two wires associated with the RF Code R130 dry content RFID tag are no longer shorted together. This will cause the RF Code R130 dry content RFID tag to cease transmitting its signal, acting as a "report by exception" notification signal to a monitoring device.

The position of the conductor 510 in screen panel 150 can be varied depending on the threshold level of wear necessary for replacement of the screen panel 150 for the particular screening application. For example, as shown in FIG. 10, a portion of conductor 510 is positioned adjacent the top surface 155 of insert 156 of screen panel 150. This configuration can be more particularly suited for the screening of aggregate material where aperture size must be closely monitored and controlled. The conductor 510 can be positioned even closer to the top surface of screen panel 150 if greater sensitivity to wear is desired. In addition, as shown in FIG. 11, a portion of conductor 510 can also be positioned beneath the top surface 155 of insert 156 of screen panel 150. This configuration can be more suitable for screening processes in which only catastrophic failure of screen panels needs to be monitored.

Figure 7:
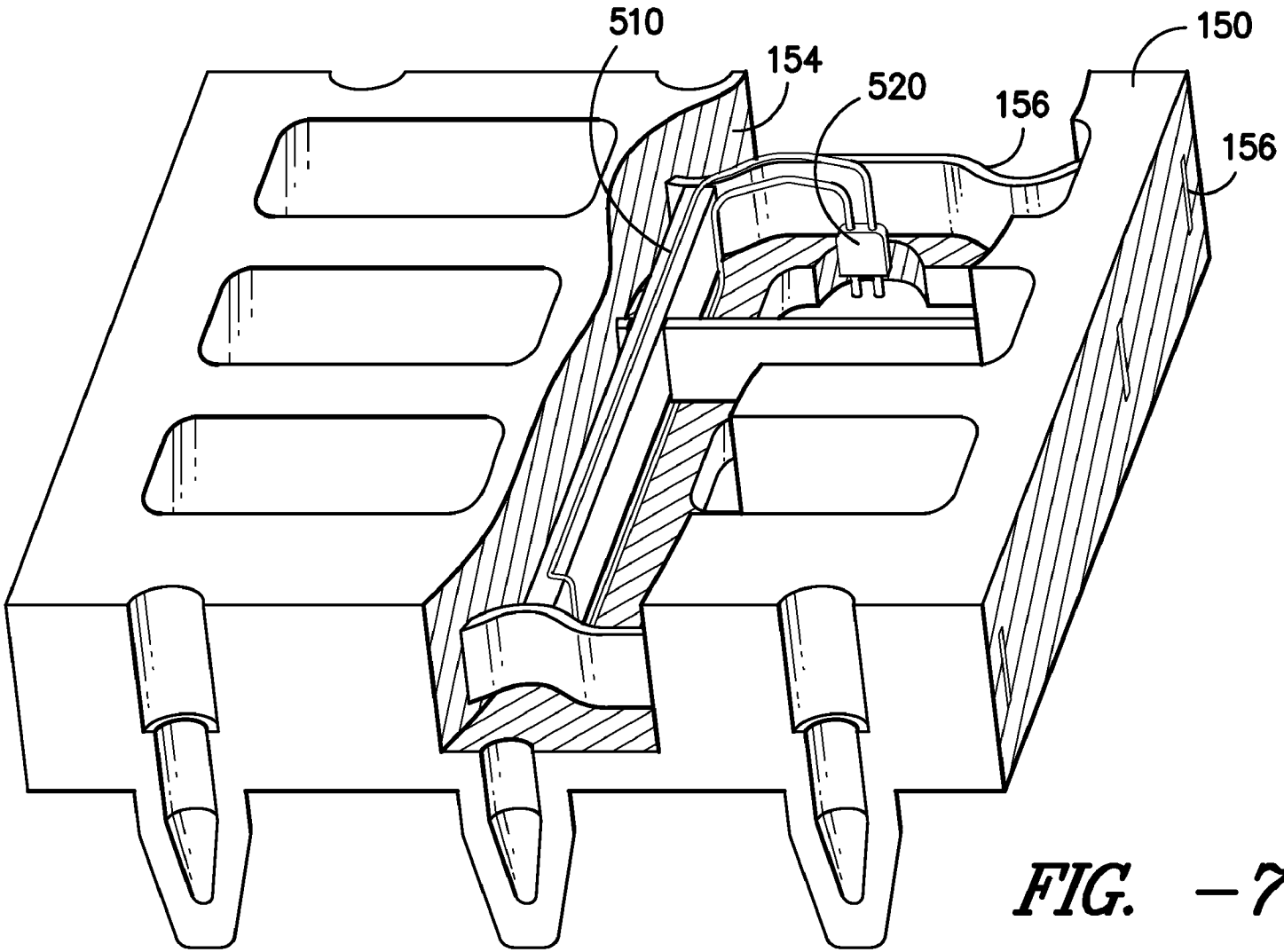
FIG. 7 provides a perspective view of an exemplary screen panel in accordance with an exemplary embodiment of the present disclosure with a portion of the screen panel cut away.
Figure 8:
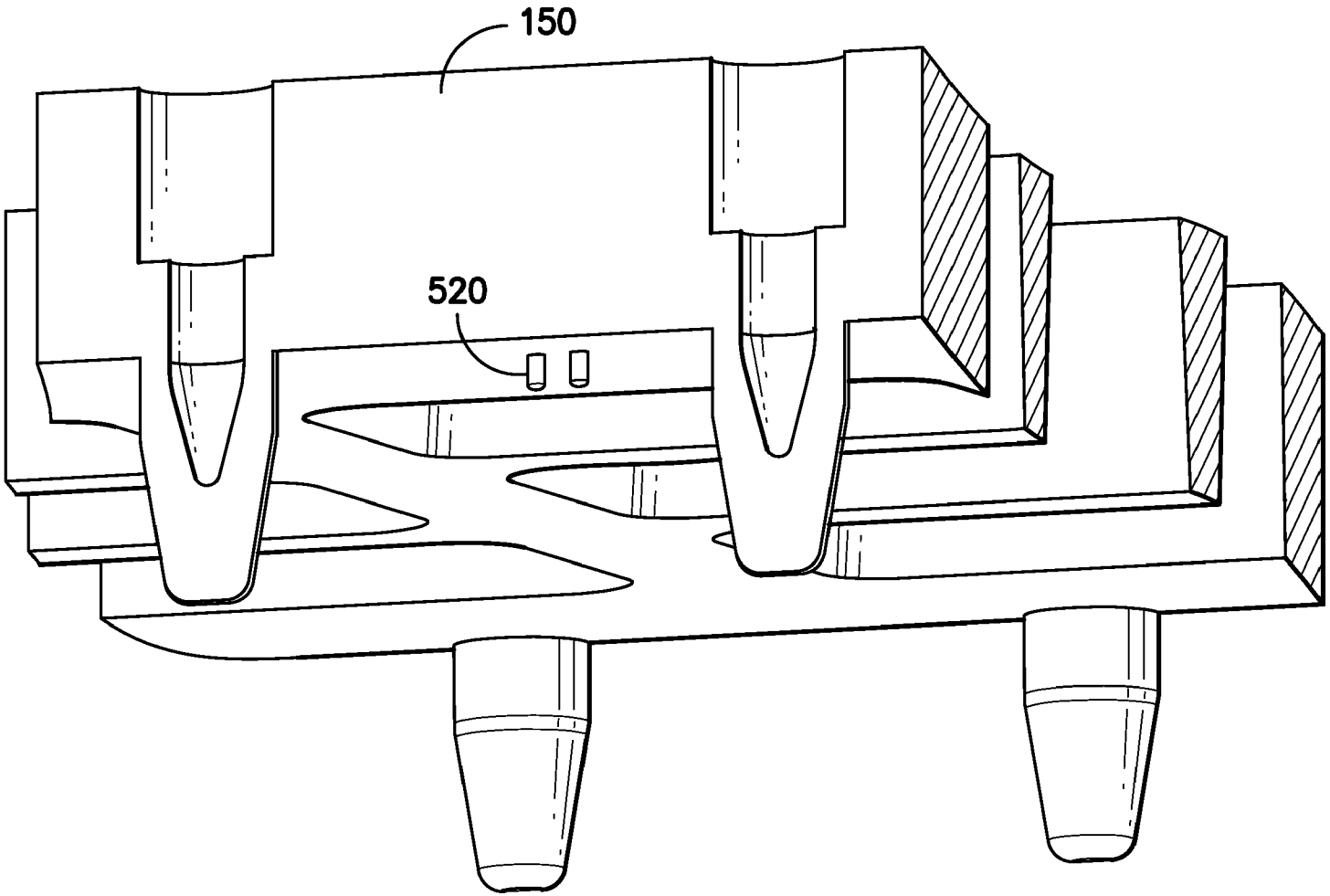
FIG. 8 provides a perspective view of a bottom surface of an exemplary screen panel in accordance with an exemplary embodiment of the present disclosure.
Figure 9:
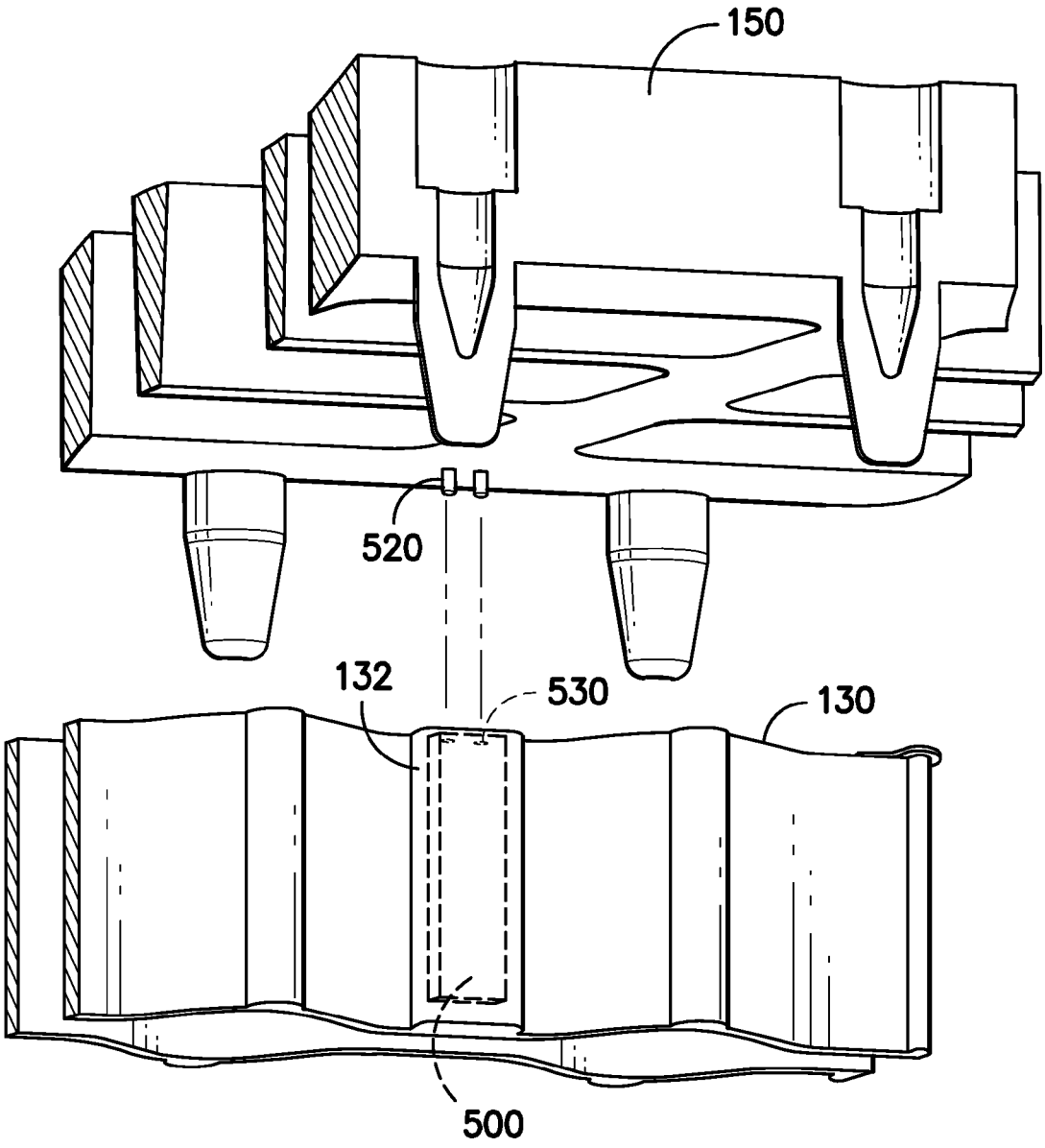
FIG. 9 provides a perspective view of engaging components of a screening arrangement according to an exemplary embodiment of the present disclosure.

FIGS. 7 through 9 illustrate exemplary embodiments of the present disclosure in which the sensor is located external to the screen panel 150. These exemplary embodiments allow for the same sensor to be reused with multiple screen panels and reduce costs by eliminating the need to embed a sensor in each individual screen panel.

FIG. 7 provides a perspective view of a screen panel 150 that includes an insert 156 and a resilient material 154 surrounding insert 156. Screen panel 150 includes a conductor 510 embedded within screen panel 150. Conductor 510 is positioned within screen panel so that conductor 510 is altered (for instance decoupled, severed, shorted, or grounded) when the screen panel 150 has worn to a threshold level. As discussed above, conductor 510 can be configured such that when the conductor 510 is altered, a sensor ceases to send a unique identification signal to a monitoring device.

As illustrated in FIG. 7, conductor 510 is directly coupled to sensor 500 through a plug connection 520. While a plug connection 520 is used in FIG. 7, those of ordinary skill in the art will also appreciate that other connections can be used. For instance, in another embodiment, conductor 510 can be coupled to sensor 500 through a proximity sensor. The proximity sensor detects the presence of conductor 510 within screen panel 150. The proximity sensor connection can be based on a capacitive, magnetic, optical, photoelectric, inductive, or other suitable connection.

FIG. 8 provides a perspective view of the bottom surface of screen panel 150 including plug connection 520. Plug connection 520 can be used to removably couple conductor 510 to an external sensor. The external sensor can be mounted, for example, to the support frame of the screening arrangement proximate the screen panel 150. The plug connection 520 illustrated in FIG. 7 and FIG. 8 includes two protrusions. However, those of ordinary skill in the art, using the disclosures provided herein, should understand that any configuration for plug connection 520 can be used without deviating from the scope of the present invention.

FIG. 9 illustrates an exemplary embodiment of the present disclosure in which a sensor 500 is located in a protective cover 130 for a support frame for a screening arrangement. As illustrated, plug connection 520 is configured to couple a conductor embedded in a screen panel 150 to an external sensor 500 located in protective cover 130 for the support frame for the screening arrangement. The protective cover 130 includes a pocket 132 for receiving and holding the external sensor 500. The external sensor 500 includes a receptacle connection 530 for receiving the plug connection 520 of the screen panel 150. A conductor embedded in screen panel 150 can be coupled to external sensor 500 by engaging plug connection 520 with receptacle connection 530. When conductor 510 is altered due to wear in the screen panel 150, sensor 500 will cease to transmit its unique identification signal.

The conductor 510 can be disengaged from external RFID device by disengaging plug connection 520 from receptacle connection 530. A new conductor associated with a new screen panel can then be engaged with the external sensor 500 by simply engaging the plug connection of the new screen panel with receptacle connection 530. When the external sensor 500 fails, the external sensor 500 can be removed from protective cover 130 and replaced with a new external sensor 500. Alternatively, protective cover 130 can be replaced with a new protective cover containing a new external sensor. In this manner, embodiments of the present disclosure can be implemented in a modular screening arrangement that allows for efficient replacement of worn screen panels, protective covers, conductors, and sensors.

By providing a sensor external to the screen panels, multiple conductors associated with multiple screen panels can be coupled or associated with the same sensor. For example, a first conductor can be located in a first screen panel and a second conductor can be located in a second screen panel. The first conductor and the second conductor can be operably coupled together so that the sensor provides a notification signal when either the first conductor has been altered in the first screen panel or when the second conductor has been altered in the second screen panel. In this manner, a single sensor can be used to detect wear in multiple screen panels without having to embed an individual sensor in each individual screen panel of the screening arrangement.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A system for detecting wear in a screening arrangement having a plurality of screen panels, comprising:

a monitoring device; and a sensor, the sensor being positioned in the screening arrangement;

wherein said sensor is configured to provide a notification signal to said monitoring device when a top surface of at least one of the plurality of screen panels has worn to a threshold level, the threshold level associated with a depth of wear of the screen panel.

2. The system of claim 1, wherein said sensor comprises a communication device, said communication device configured to communicate the notification signal to said monitoring device.

3. The system of claim 1, wherein said communication device comprises an RFID device.

4. The system of claim 1, wherein said sensor comprises an RFID device.

5. The system of claim 1, wherein said system comprises a conductor located in one of the screen panels of the screening arrangement, said conductor positioned in the screen panel so that said conductor is altered when the screen panel has worn to the threshold level.

6. The system of claim 5, wherein said conductor is coupled to said sensor.

7. The system of claim 6, wherein said sensor provides the notification signal when said conductor becomes decoupled from said sensor.

8. The system of claim 5, wherein said sensor provides the notification signal when said conductor is shorted or grounded.

9. The system of claim 5, wherein said sensor provides the notification signal when said conductor is severed.

10. The system of claim 1, wherein said sensor is located in one of the plurality of screen panels of the screening arrangement.

11. The system of claim 1, wherein said sensor is located external to the plurality of screen panels of the screening arrangement.

12. A screening arrangement for use in screening materials, comprising:

a support member;

a screen panel secured to said support member, said screen panel comprising a peripheral edge portion and a plurality of ribs extending from the peripheral edge portion to define a screening surface, the plurality of ribs defining one or more apertures in the screen panel; and a sensor mounted in said screening arrangement, said sensor configured to provide a notification signal to said monitoring device when the screening surface of the screen panel has worn to a threshold level, the threshold level associated with a depth of wear of the screen panel.

13. The screening arrangement of claim 12, wherein said screening arrangement further comprises a conductor located in said screen panel, said conductor positioned in said screen panel so that said conductor is altered when the screening surface of said screen panel has worn to a threshold level, said sensor providing a notification signal when said conductor is altered in said screen panel.

14. The screening arrangement of claim 12, wherein said sensor is located in said screen panel.

15. The screening arrangement of claim 12, wherein said sensor is mounted to said support member.

16. The screening arrangement of claim 12, wherein the screening arrangement further comprises a protective cover mounted to said support member, said sensor being located in said protective cover.

17. The screening arrangement of claim 16, wherein said screen panel is coupled to said sensor through a plug connection.

18. The screening arrangement of claim 12, wherein said screen panel is coupled to said sensor through a proximity sensor.

19. A screen panel comprising a peripheral edge portion and a plurality of ribs extending from the peripheral edge portion to define a screening surface, the plurality of ribs defining one or more apertures in the screen panel, the screen panel further comprising a sensor mounted in the screen panel, said sensor configured to provide a signal indicative of a depth of wear in said screen panel.

20. The screen panel of claim 19, wherein said sensor comprises a communication device.

21. The screen panel of claim 20, wherein said communication device comprises an RFID device.

22. The screen panel of claim 19, wherein said sensor comprises an RFID device.

23. The screen panel of claim 19, wherein said screen panel further comprises a conductor mounted in said screen panel, said sensor configured to provide a notification signal when said conductor is altered in said screen panel.

24. The screen panel of claim 23, wherein said conductor is positioned in the screen panel such that said conductor becomes altered when said screening surface of said screen panel has worn to a threshold level.

25. A screen panel for use in a system for detecting wear in a screening arrangement, the screen panel comprising:

a peripheral edge portion and a top surface formed at least partially from a resilient material;

a conductor embedded in said resilient material, said conductor being positioned in said resilient material so that said conductor is altered when the top surface of said screen panel has worn to a threshold level, the threshold level associated with an amount of wear of the screen panel that affects aperture size of the screen panel;

wherein said conductor is configured to be coupled to a sensor that provides a notification signal when said conductor is altered in the screen panel.

26. The screen panel of claim 25, wherein said screen panel comprises a plug connection coupled to said conductor.

27. The screen panel of claim 25, wherein the sensor comprises an RFID device.

28. The screen panel of claim 25, wherein said conductor is positioned along a top surface of a frame embedded in the screen panel.

29. The screen panel of claim 25, wherein said conductor is positioned below the top surface of a frame embedded the screen panel.

30. The screen panel of claim 25, wherein said resilient material comprises a polymeric material.

31. A method for detecting wear in a screen panel, comprising:

associating a sensor with a screen panel;

monitoring signals from the sensor associated with the screen panel; and receiving a notification signal from the sensor associated with the screen panel when the screening surface of the screen panel has worn to a threshold level, the threshold level associated with a depth of wear of the screen panel.

32. The method of claim 31, wherein the method further comprises providing an alert when a notification signal is received from the sensor associated with the screen panel.

33. The method of claim 32, wherein the method further comprises replacing the screen panel after receiving the notification signal from the sensor associated with the screen panel.

34. The method of claim 31, wherein said sensor comprises an RFID device.

35. The method of claim 34, wherein the method comprises:

receiving a routine RFID signal from the RFID device; and determining that a notification signal has been received from the RFID device when the routine RFID signal from the RFID device is no longer received.

36. The method of claim 31, wherein the method comprises associating a plurality of screen panels with the sensor.

37. The method of claim 31, wherein associating a sensor with a screen panel comprises positioning a conductor in the screen panel such that the conductor becomes altered when the screening surface of the screen panel has worn to a threshold level, the sensor providing the notification signal when the conductor becomes altered in the screen panel.

38. The system of claim 1, wherein the threshold level is associated with a depth of wear that affects an aperture size of the screen panel.

39. The screen panel of claim 19, wherein the signal indicative of depth of wear is associated with a depth of wear that affects a size of the one or more apertures in the screen panel.

40. The method of claim 31, wherein the threshold level is associated with a depth of wear that affects an aperture size of the screen panel.

* * * * *